US005137044A

United States Patent [19]

Brady

[11] Patent Number: 5,137,044

[45] Date of Patent: Aug. 11, 1992

[54] COLLAPSIBLE TENT STRUCTURE

[76] Inventor: David S. Brady, 807 Casa Blanca, Fullerton, Calif. 92632

[21] Appl. No.: 597,362

[22] Filed: Oct. 12, 1990

[51] Int. Cl.[5] ..... E04H 15/40

[52] U.S. Cl. ..... 135/104; 135/106

[58] Field of Search ..... 135/104, 106, 115, 117

[56] References Cited

U.S. PATENT DOCUMENTS

| | | | |
|---|---|---|---|
| 3,675,667 | 7/1972 | Miller | 135/104 |
| 3,960,161 | 6/1976 | Norman | 135/104 |
| 4,198,996 | 4/1980 | Keable et al. | 135/117 X |
| 4,743,215 | 5/1988 | Emmons | 135/117 X |
| 4,825,892 | 5/1989 | Norman | 135/104 |
| 4,838,293 | 6/1989 | Novak | 135/105 X |
| 4,858,634 | 8/1989 | McLeese | 135/104 |
| 4,858,635 | 8/1989 | Eppenbach | 135/117 X |
| 4,951,333 | 8/1990 | Kaiser et al. | 135/104 X |
| 5,031,652 | 7/1991 | Lester | 135/104 |
| 5,038,812 | 8/1991 | Norman | 135/104 |

*Primary Examiner*—David A. Scherbel
*Assistant Examiner*—Lan Mai
*Attorney, Agent, or Firm*—Knobbe, Martens, Olson & Bear

[57] ABSTRACT

A lightweight tent which is virtually self-erecting and free-standing. It does not require any stakes, poles, shock cords, or ropes to support it. The tent of the present invention generally has four fabric walls and a floor. It is supported by two flexible hoops, each sewn into a portion of one of two opposing sidewalls. The floor is attached to the bottom of these sidewalls as well as the other two sidewalls. When erect, the top of the hoops nest, one inside the other, while the bottom of the hoops are spaced apart to form the floor area. The tent can be easily and compactly collapsed with a simple twisting and folding motion into three concentric, circular loops, each approximately one third the size of the original hoop. It attaches to the outside of a backpack, saving internal space and sheltering the pack.

3 Claims, 5 Drawing Sheets

Fig. 1
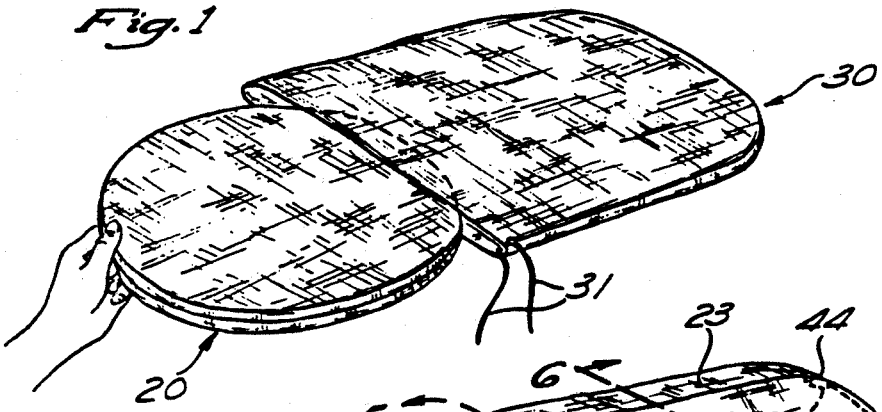
Fig. 2
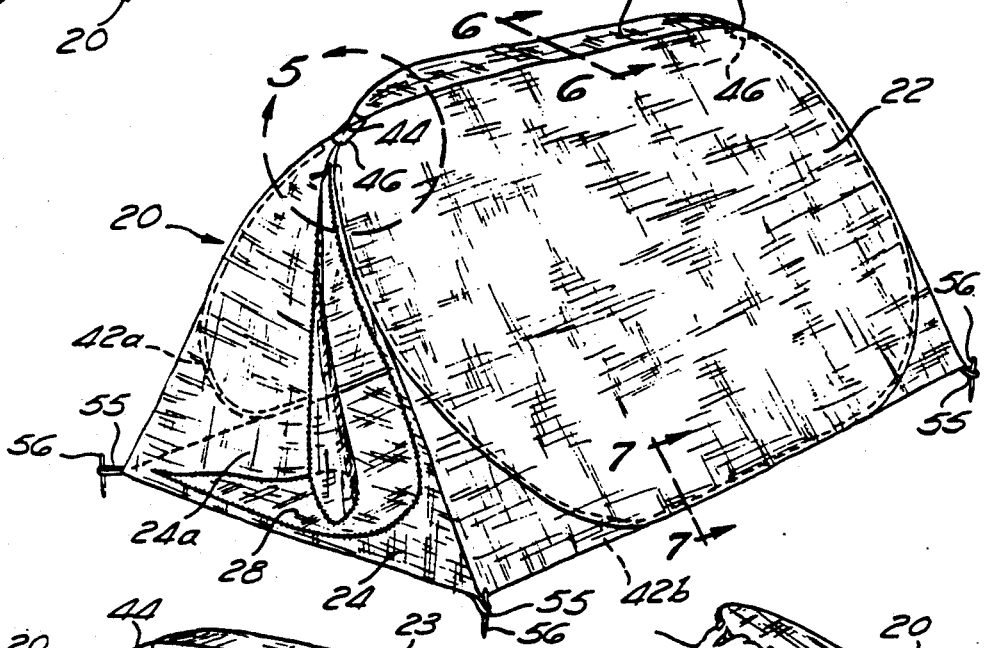
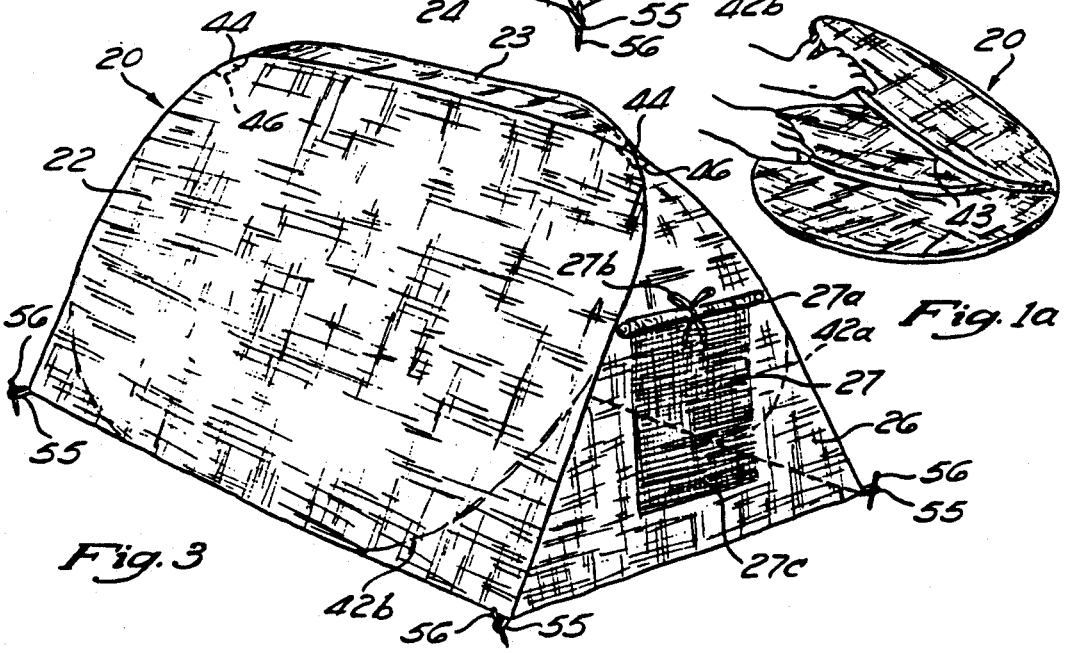
Fig. 3
Fig. 1a

Fig. 11
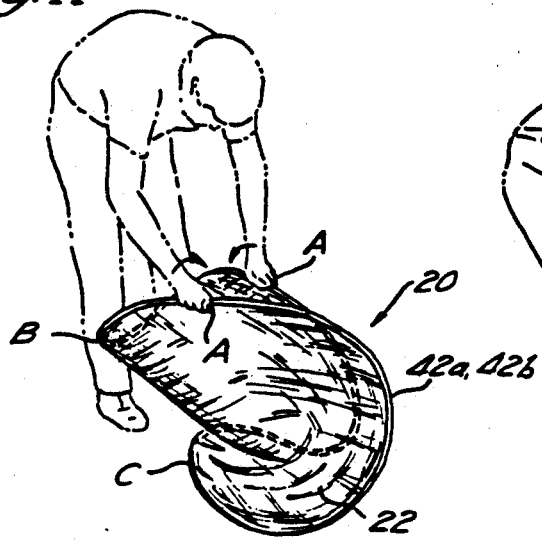
Fig. 15
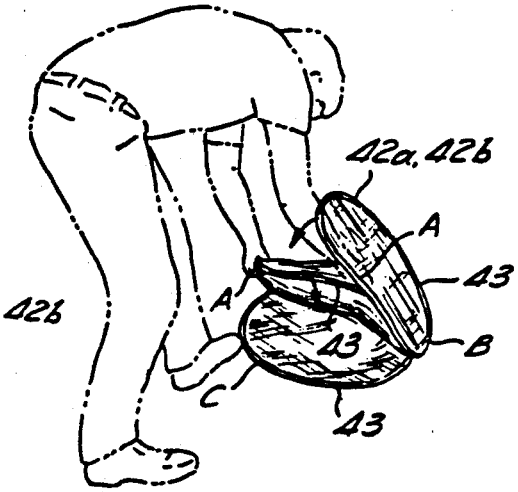
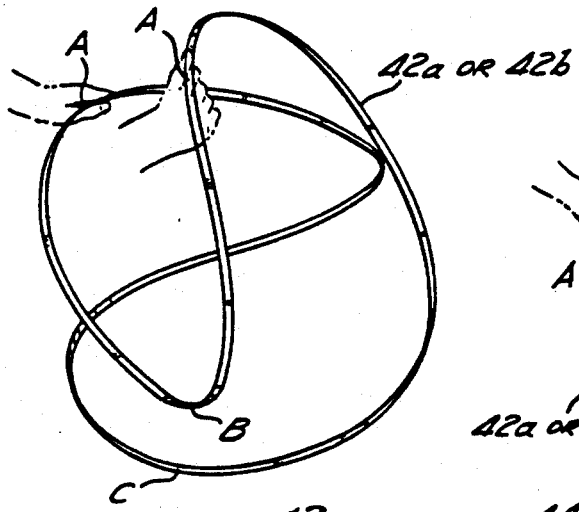
Fig. 12
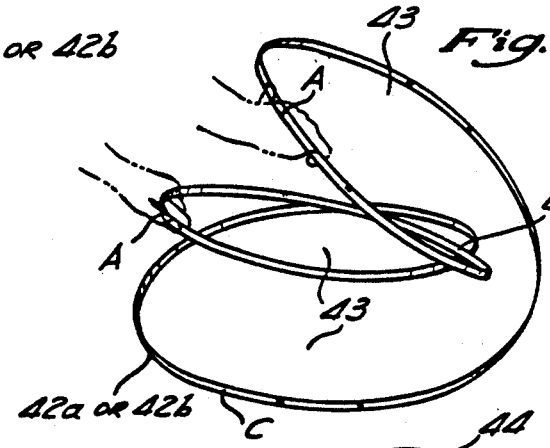
Fig. 14
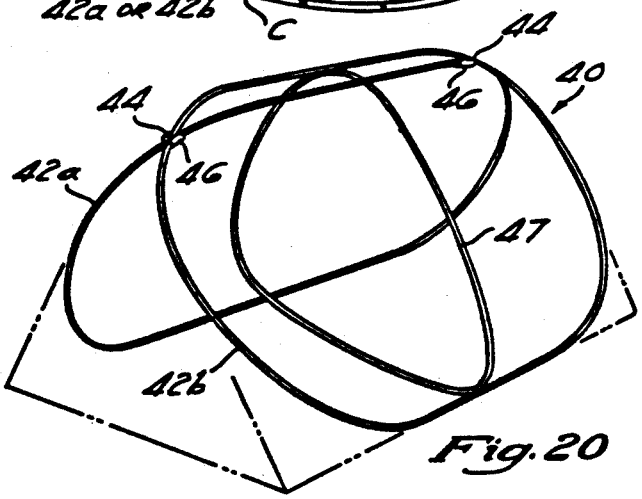
Fig. 20
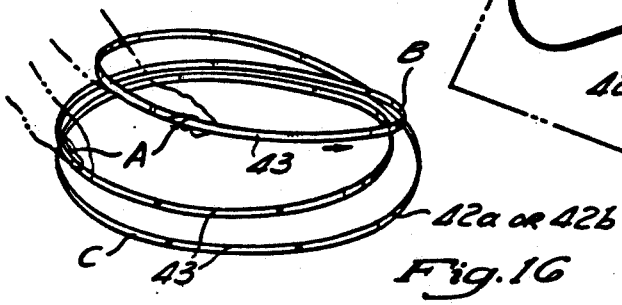
Fig. 16

42a
50
42b
19a
22
65
22a 19a
50
42b
65
22b
42a
22a
65

65
22b
42b
23
42a
23a
44
50a
50a
50
50
42b
42a
22a
65
22b
20
22a
28
42b
50
23
22b
18a
23a
42a
44
65
42b
65
22a
18a
24
24a 20
50
23
44
42a
20
44
42b
45
24a
45a
56
55
56
45a
55
28
24
55
56

COLLAPSIBLE TENT STRUCTURE

FIELD OF THE INVENTION present invention relates to portable shelters More specifically, the present invention relates to tents and their conversion from a pitched position for use to a collapsed position for transport.

BACKGROUND OF THE INVENTION

Hikers generally need a lightweight structure for sleeping outdoors that can be easily disassembled into a compact form and easily carried. Additionally, this structure needs to be easy to erect, without a multitude of easily lost parts that make the tent difficult to assemble, disassemble, and re-package for carrying.

Tents that satisfy the small size and few parts requirements have been developed without, however, satisfying the need for true ease of assembly and disassembly. Among these tents are ones in which a continuous band of spring coil is covered with fabric such that the device pops up into a tent, such as the structure illustrated in U.S. Pat. No. 3,675,667 to Miller. This device does not easily return to its disassembled form. A person must straddle the tent and struggle to loop one end toward the middle of the tent. Then the person must loop the other end over the first loop, all the while kneeling on the first loop to hold it in place. When this process has been accomplished, the user must fasten the ties on the tent so that the structure will not spontaneously spring back into erect shape.

Another structure of this nature is described in U.S. Pat. No. 3,990,463 to Norman. Again, a continuous band of spring steel is utilized. A length of spring steel is twisted 360 degrees and then connected to form a loop. Thus, when the loop is connected, each straight section is twisted 180 degrees. To relieve tension thus created, the frame naturally crosses over into a figure-eight shape.

The crossing point of the figure-eight forms the apex of the tent and the top and bottom of the figure-eight extend downwardly to touch the ground. To secure a length of the spring steel to the ground, stakes are used to tension the fabric panels of the tent, thereby compressing the frame toward the ground. The tent cannot stand independently, i.e., the tent must be staked to the ground.

Disassembly of this tent is awkward. The operator is first required to force the top and bottom of the figureeight shape together. The tension created by the 360 degree twist makes this difficult. The remainder of the collapsing motion is not possible until the first step is complete. Thus, this tent is not easily collapsed into compact form.

A spring loaded collapsible sunshade is disclosed in U.S. Pat. No. 4,815,784 to Zheng. This sunshade has two generally circular flexible spring steel loops which are positioned side by side. These loops are typically covered with fabric and have a fabric hinge in between them, completely separating one loop from the other. The sunshade is placed in the windshield of an automobile and held in place by rotating the visors down.

The Zheng sunshade is collapsed by folding the sunshade about the longitudinal axis of the fabric hinge such that one loop is arranged over the other. A bending and twisting operation collapses the sunshade into three concentric circles. Thus, the sunshade becomes approximately one-third the size of each initial circular loop of the sunshade.

However, the Zheng sunshade is not useful as a tent. It does not have sidewalls to connect the fabric covering the loops, which would allow wind, rain, snow, and other elements to enter. Additionally, the sunshade has no floor to protect a person from insects, snakes, plant life, etc. Most importantly, the sunshade has a fabric hinge between the two loops. Each loop is totally surrounded by fabric and totally separated from the other loop. The loops of the sunshade cannot form a frame for a tent since they can only lean against each other, providing little or no stability. Thus, the sunshade disclosed in the Zheng patent cannot provide a free-standing frame for a shelter.

SUMMARY OF THE INVENTION

The present invention is a lightweight, easily assembled and disassembled shelter of primary use to hikers, backpackers, campers, and others who need portable shelter. The assembled shelter has two adjacent generally oval-shaped hoops, made of spring steel or other flexible material for example, over which fabric covering is attached to provide a plurality of sheltering sidewalls and a floor. The tent is essentially self-erecting and free-standing, with no need for ropes, shock cords, poles or stakes. By a simple twisting and folding motion the tent can be collapsed into a compact bundle. The oval hoops easily collapse into concentric circles of smaller circumference than the original hoops. These smaller loops stay collapsed until sufficient force is applied to cause them to open, thus erecting the tent. One person can easily assemble and disassemble the tent into compact form. Additionally, the tent can be stored for travel in its compact form without uneasiness about the tent springing open. The collapsed tent may be attached to the outside of a backpack. This facilitates transport and use of the tent by campers with little room for extra gear.

In accordance with the present invention, a tent structure comprising a plurality of flexible hoop members is provided. Each hoop member is generally oval-shaped in an expanded position and collapses into three generally circular loops of a smaller size than the expanded oval-shape. The tent additionally comprises a cover panel extending over said flexible hoop members which is affixed to the hoop members at several points along a perimeter of the hoop members to form opposing first and second side walls when the hoop members are in said expanded position. Each of the side walls has an upper and a lower edge wherein the upper edges of the first side wall and the second side wall form an apex. The structure further comprises a floor panel affixed to the lower edge of the first side wall and the lower edge of the second side wall.

The structure may additionally comprise front and rear end walls and a door in one of the end walls. The door may be formed by cutting a portion of the end wall to form an opening and inserting a zipper means to reattach the cut out portion. The door may further comprise a mesh covering placed over the opening. The structure may further comprise a window in one of the end walls. The window may comprise a rectangular section cut out of the end wall to form a cut-away area having a fourth edge remaining attached to the end wall. The window may further comprise a mesh covering placed over the cut-away area. Moreover, the structure may comprise a ridgeline retainer affixed to the upper edge of the first side wall and the upper edge of the second side wall.

The structure may be constructed wherein a first one of the flexible hoop members in its expanded position is smaller than a second one of the flexible hoop members in its expanded position such that the first and second hoop members can be nested. This construction may further comprise a yoke which secures the first and second hoop members at preselected cross-over points, yet allows motion of the flexible hoop members relative to one another. The yoke may comprise a leather yoke affixed to the side walls. The yoke may also comprise a ring around said cross-over point.

Another embodiment of the present invention includes a collapsible structure comprising first and second hoop members wherein each hoop member comprises a continuous closed loop resilient member and wherein each of the hoop members has an expanded position and a collapsed position. The structure additionally comprises a first side wall formed by extending a first sheet of material over the first hoop member, the side wall having an elongated ground rail edge and an elongated roofline edge. The structure further comprises a second side wall formed by extending a second sheet of material over the second hoop member, the side wall having an elongated ground rail edge and an elongated roofline edge. Further included in the structure is a floor formed by extending a sheet of material between the first and second side wall ground rail edges. The collapsible structure may further comprise a ridgeline support formed by extending a sheet of material between the first and second side wall roofline edges. Additionally, this collapsible structure may be of a construction wherein the first sheet of material, said second sheet of material and the sheet of material forming the floor are all portions of a single sheet of material. The collapsible structure may further be of construction wherein the first and second hoops in their expanded positions define generally planar first and second ar®as and are configured such that in the expanded configuration of the structure, the first and second planar areas intersect. The collapsible structure may further be formed wherein the first and second side walls further comprise two substantially parallel sheets of material with an insulating space therebetween.

Yet another embodiment of the present invention provides a portable collapsible structure comprising a frame having a plurality of flexible hoop members wherein each hoop member has an extended state and a collapsed state. The structure further comprises a first fabric covering extending over the flexible hoops forming first and second opposing side walls into which a first portion of the perimeter of each of the flexible hoops are attached to form a first side wall layer while a second portion of the flexible hoops overlap one another. The structure further comprises a second fabric sheet attached between the side walls forming additional first and second end walls and a floor. The structure additionally comprises a third fabric covering extending over said flexible hoops forming a second layer of side walls, wherein the second layer is spaced slightly apart from the first layer. The structure may be of construction wherein the second fabric layer is attached to the floor of the structure and to the first sidewalls generally along said portion of the perimeter of the flexible hoops which are attached to the first sidewall. The second fabric layer may be draped over the top of the frame. Additionally, the second fabric layer may be generally non-permeable.

Yet another embodiment of the present invention is a collapsible tent comprising a plurality of flexible hoop members which are generally oval-shaped in an expanded position and collapse into three generally circular loops of a smaller size, one of the flexible hoops crossing over another of the flexible hoops to form a cross-over point when the tent is in erect position. The collapsible tent further comprises a first fabric covering extending under the flexible hoops, forming two opposing first side wall layers into which the perimeter of the flexible hoops excluding the general area of the cross-over points is generally encased in protruding channels of the first fabric. The tent additionally comprises a second fabric sheet attached between the side walls forming end walls and a floor. Further, the tent comprises a third fabric covering extending over the flexible hoops forming a second layer of side walls, wherein the second layer is spaced slightly apart from said first layer. Furthermore, the second fabric layer may be generally non-permeable.

In another aspect of the present invention, a collapsible structure is provided comprising first and second hoop members wherein each hoop member comprises a closed loop resilient member and wherein each of the hoop members has an expanded configuration and a collapsed configuration. Further, the structure comprises a first wall formed by extending a first sheet of material over the first hoop member, the first wall having a first rail edge portion and a second rail edge portion. Additionally, the structure comprises a second wall formed by extending a second sheet of material over the second hoop member, the second wall having a first rail edge portion and a second rail edge portion. Further, the structure comprises an apex supported by said first and second wall second rail edge portions. Moreover, the structure comprises a floor formed by extending a sheet of material between the first and second wall first rail edge portions.

Yet another aspect of the present invention provides a structure comprising first and second hoop members wherein each hoop member comprises a closed loop resilient member and wherein each of the hoop members has an expanded configuration and a collapsed configuration. The structure further comprises a cover panel extending over the first and second hoop members and affixed to the hoop members at several points along a perimeter of the hoop members to form opposing first and second side walls when the hoop members are in their expanded position, each of the side walls having an upper and a lower edge wherein the upper edges of the first side wall and the second side wall cooperate to form an apex. This embodiment may further comprise a floor panel affixed between the first and second side wall lower edges.

The present invention may also be embodied in a method of constructing a structure comprising the steps of providing first and second hoop members wherein each hoop member comprises a closed loop resilient member and wherein each of the hoop members has an expanded configuration and a collapsed configuration. Further, the method comprises expanding the first and second hoop members to their expanded configurations. Moreover, the method comprises extending a cover panel over the first and second hoop members and affixing the cover panel to said hoop members at several points along a perimeter of the hoop members to form opposing first and second side walls when the hoop members are in their expanded position such that each of the side walls has an upper and a lower edge. Additionally, the method comprises positioning the upper edges of the first side wall and the second side wall so that they cooperate to form an apex. The method may further comprise the step of affixing a floor panel between the first and second side wall lower edges.

BRIEF DESCRIPTION OF THE DRAWINGS

FIG. 1 is an illustration of the tent in its collapsed form and the carrying bag in which the tent is stored for transport.

FIG. 1*a* is an illustration of the three concentric loops of the collapsed tent, showing how the three loops stay collapsed even with the application of some force against the restoring force of the spring steel. Only with enough force to overcome the restoring force of the spring will the three loops expand.

FIG. 2 is a perspective view of the tent in its erect form. The front sidewall and entrance door are shown.

FIG. 3 is a perspective view of the tent in its erect form. The back sidewall and ventilation window are shown.

FIGS. 8 through 16 are an illustration of the method by which a single person can easily collapse the tent.

FIG. 20 is a further embodiment of the collapsible tent wherein a third oval hoop, inserted in a plane perpendicular to the longitudinal axis, at approximately the center of the tent, provides additional stability for the tent.

DETAILED DESCRIPTION OF THE INVENTION

Figure 4:
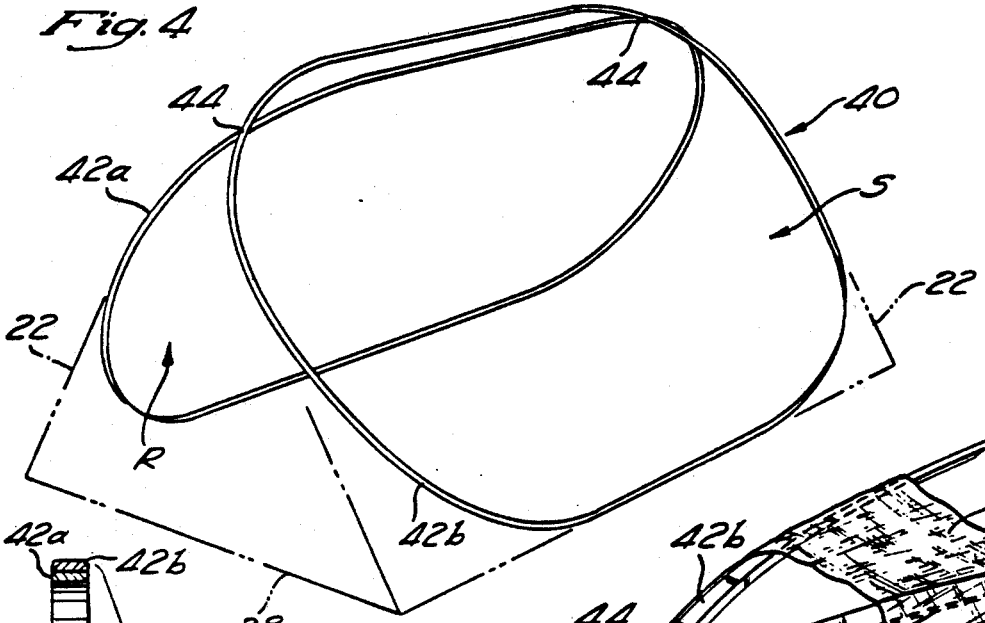
FIG. 4 is an illustration of the frame of the erected tent, showing now one loop nests inside the other for structural support.

FIG. 1 shows the collapsed form of the tent 20 of the present invention and a carrying case 30 in which it is stored for easy transport. The carrying case 30 also insures that the collapsed tent 20 does not unintentionally receive enough force to cause it to spontaneously expand. The carrying case 30 is made of fabric which can be water resistant fabric such that the tent 20 is prevented from getting wet in moist hiking regions or in the rain. It has a closure such as a drawstring 31 to retain the tent 20 inside the case 30. The tent 20 is lightweight and will attach to the outside of a backpack for easy carrying. This saves internal pack space while, additionally, sheltering the backpack.

FIG. 1*a* shows the structure of the collapsed tent 20. There are three concentric, approximately circular loops 43. These three loops 43 remain in position adjacent one another until enough force is applied to the three loops 43 to expand the tent 20. A slight amount of force on the three concentric loops 43 will not expand the tent 20. Thus, the tent 20 will stay in its collapsed form until assembly is desired.

FIGS. 2 and 3 show a perspective front and back view, respectively, of the erected tent 20. It is generally triangular in lateral cross section and generally a modified oval shape in longitudinal cross section. Making up a fabric shell are two side walls 22, a fabric ridgeline support 23 connecting the two sidewalls 22 at the top of the tent 20, a front wall 24 with a door flap 24*a*, a back wall 26 with a ventilating window 27, and a floor 28. The shell is made of generally water resistant, lightweight fabric such as E.I. DuPont de Nemours' trademark fabrics Nylon® and Dacron®, W.L. Gore's Goretex®, or polymer-coated cotton. The sidewalls 22 and fabric ridgeline support 23 can be separate pieces connected by stitching or riveting, for example, or they can be manufactured from a single panel of material, folded over the top of the frame. The door flap 24*a* is formed with a zipper closure in the front wall 24 starting at the top of the tent 20, running parallel to one of the sidewalls 22, curving such that it runs parallel to the floor 28, and ending near the opposite sidewall 22. The ventilating window 27 is formed having three edges of a rectangular area of the back wall 26 are cut out, leaving the fourth edge attached to the tent 20 such that a window flap 27*a* is formed. This fourth edge has a tie 27*b* both above and below the window flap 27*a*. The two ties can be tied together around the rolled up flap 27*a* to hold the window 27 open. A fabric mesh screen 27*c* is sewn over the area of the back wall where the window flap 27*a* was cut out. Thus, when the window flap 27*a* is rolled up such that the window 27 is open, insects cannot access the interior of the tent 20. Windows 27 of the same sort can be placed at other advantageous locations on the tent 20.

The frame 40 of the tent 20, shown in FIG. 4, comprises two oval hoops 42*a* and 42*b* of rectangular cross-section. Typically, the hoops 42*a* and 42*b* that make up the frame 40 are fabricated from a flexible material such as plastic, fiberglass, graphite, wood, aluminum or spring steel. One of the hoops 42*a* is slightly smaller than the other hoop 42*b*. The smaller hoop 42*a* is designed such that when the tent is erect the hoop 42*a* lies in a plane R which extends from the bottom of the sidewall 22 nearest the hoop 42*a* to the edge of the fabric ridgeline support 23 which is connected to the sidewall 22 opposite the hoop 42*a*. Thus, the distance between the outer edges of the straight parts of the smaller hoop 42*a* is approximately equal to the distance in the plane R between the line which connects the floor 28 to the sidewall 22 and the line which connects the opposite sidewall 22 to the fabric ridgeline support 23. The slightly larger hoop 42b has an inner perimeter approximately equal to the outer perimeter of the smaller hoop 42a. The preferred embodiment of the tent 20 uses spring steel hoops 42a and 42b having a cross-section wherein the width is greater than the height. The cross-section can be any shape conforming to this guideline, including rectangular, oval, etc. While this is preferred, other cross-sections, such as square or circular, could be used.

Figure 5:
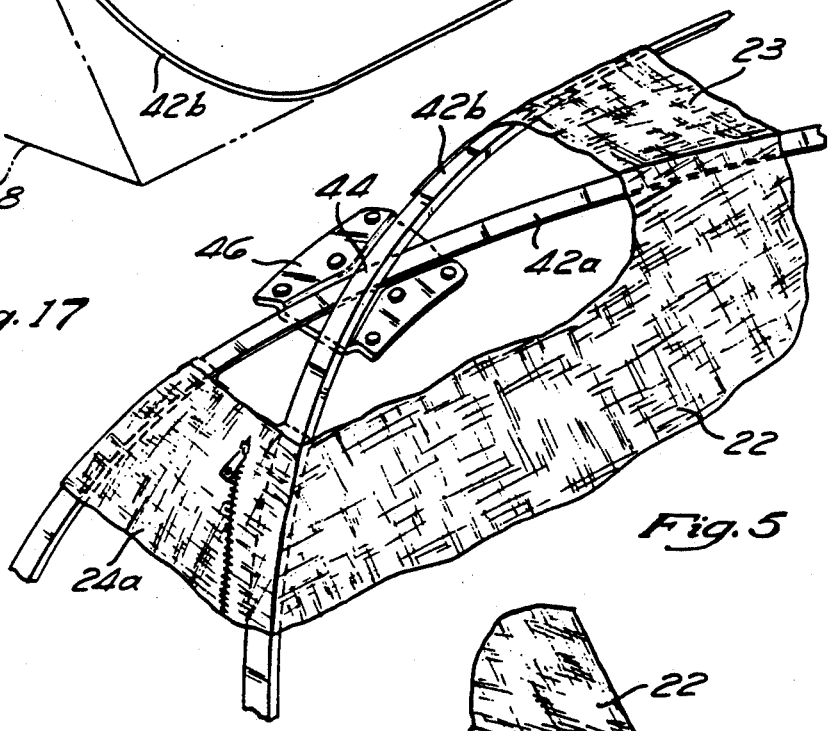
FIG. 5 is an illustration of one of the cross-over points of the discrete loops of spring steel and the yoke which anchors the loops to the sidewall fabric. The yoke fixes the cross-over point in approximately one position with respect to the fabric.

When the tent 20 is erect, the oval hoops 42a and 42b are arranged with their major axes substantially parallel to the floor 28 of the tent 20. The two hoops 42a and 42b are angled such that the smaller hoop 42a lies in the plane R and the larger hoop lies in a plane S which extends from the bottom of the sidewall 22 nearest the larger hoop 42b to the edge of the fabric ridgeline support 23 which is connected to the opposite sidewall 22. The smaller hoop 42a nests inside the larger hoop 42b. This forms two cross-over points 44 at the top of the tent 20, one near the front door 24a, as shown in FIG. 5, and one near the back wall 26. In the preferred embodiment of the tent 20, the larger hoop 42b is on top at each cross-over point 44, i.e., the hoops 42a and 42b are not intertwined. However, the tent 20 of the present invention could be constructed with the hoops 42a and 42b intertwined. The fact that the hoops 42a and 42b are nested in the preferred embodiment, i.e., one hoop 42b accepts the other hoop 42a within its interior, provides greater stability than just leaning the two against each other.

To further stabilize the tent 20, a yoke 46 to anchor the cross-over point 44 with respect to the fabric can be used as shown in FIG. 5. The yoke 46 is generally made of leather, a metal ring, or another resilient material. A leather yoke patch 46 is riveted at six points, three on each sidewall. The three rivets are arranged on the sidewall in a V-shape with the apex of the V in close proximity to the cross-over point 44. This keeps the two hoops 42a and 42b of the frame from shifting with respect to the tent 20 While still allowing the hoops' 42a and 42b scissor motion, or motion relative to one another, during collapse of the structure. For extra cross-over point 44 security, a second leather yoke patch 46 can be added outside the tent's fabric shell over the first leather yoke patch 46 and riveted at the same places as the first leather yoke patch 46. The leather yoke patches 46 ensure that the hoops 42a and 42b stay nested. Thus, the yokes 46 help ensure that the tent 20 stays erect. If a metal ring is used rather than a leather yoke patch 46, the ring is aligned to allow movement of the hoops 42a and 42b relative to one another while insuring that they remain crossed-over while the tent 20 is erect.

Figure 6:
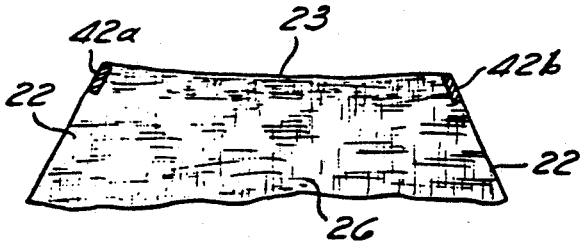
FIG. 6 is a cross sectional view along line 6—6 in FIG. 2.

The fabric ridgeline support 23 at the top of the tent 20 extends laterally between the dislocated hoops 42a and 42b and longitudinally between the crossover points 44 at the front and the back of the tent 20. A cross sectional view, taken along line 6—6, of the fabric ridgeline support 23 at the top of the tent 20, the extending sidewalls 22, and the cross-section of the two spring steel hoops 42a and 42b, is shown in FIG. 6. The fabric ridgeline support 23 allows the hoops 42a and 42b to be displaced at the top of the tent 20, while helping both to hold them in place and to keep the frame 40 erect.

Each of the oval hoops 42a and 42b is attached to the floor of the tent 28 along the straight portions of the hoop 42a or 42b adjacent the floor 28. Additionally, each hoop is further connected to the bottom portion of the sidewall 22 nearest the hoop 42a or 42b. At the top of the tent 20, the hoops 42a and 42b are not attached to the fabric of the tent 20. However, the leather yoke patches 46, or other cross-over point yoke apparatuses 46, will couple the spring steel hoops 42a and 42b to the top of the tent 20 while still allowing the hoops 42a and 42b to scissor relative to one another in collapsing the tent 20.

Channels 50 are created around the portions of the spring steel hoops 42a and 42b which are connected to the shell of the tent 20. The spring steel hoops 42a and 42b rest inside the fabric shell. The channels 50 are formed by sewing a substantially rectangular strip of fabric to the inside of the shell of the tent 20 where the spring steel hoops 42a and 42b are to be attached. The strip of fabric is wide enough that the channel 50 created in this manner encases the rectangular cross-section spring steel hoops 42a and 42b. Along the bottom of the tent 20, one side of the strip is sewn to the sidewall 22, slightly inward from the sidewall 22 edge. The other edge of the strip is incorporated into the seam connecting the sidewall 22 and the floor 28. Along the upwardly extending sides of the hoops 42a and 42b, the strip is sewn to the sidewalls 22 such that it conforms to the curve of the hoops 42a and 42b. Thus, the strip is sewn near the edges of the sidewalls 22, but not exactly conforming to the edges of the sidewalls 22.

Figure 7:
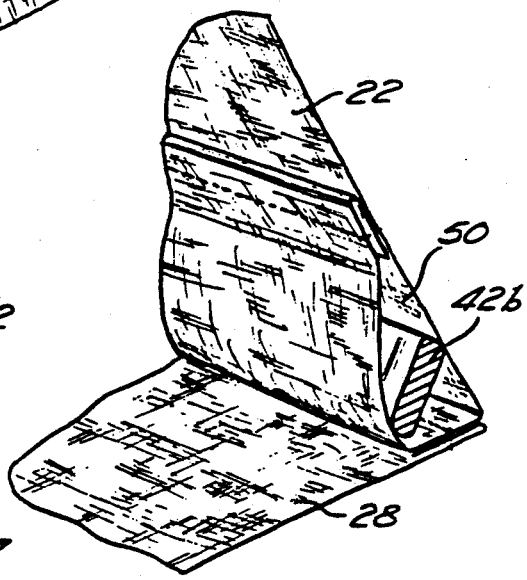
FIG. 7 is a cross sectional view along line 7—7 in FIG. 2. It illustrates one way to secure the spring steel in fabric channels sewn along a portion of the edges of the tent.

One way to affix the strip such that it creates a channel 50 around each hoop 42a and 42b is shown in cross-section in FIG. 7, taken along line 7—7 in FIG. 2. The bottom of the doubled-over strip of fabric is stitched to the area of the sidewall 22 closer to the edges, while the top edges are gathered, folded over, and affixed to the fabric of the sidewall 22 slightly inward from the edges. Thus, the fabric forms a channel around the spring steel hoops 42a and 42b having two stitched lines, one along each channel edge. The two lines formed by stitching along the edges of the rectangular strip of fabric are generally parallel, spaced apart such that the spring steel hoops 42a and 42b fit inside the channel 50 created. In this manner, the fabric is attached to the spring steel hoops 42a and 42b such that when the frame 40 is erect the fabric is compelled to unfold with the spring steel and, further, is held in tension by the expanded hoops 42a and 42b.

The tent 20 is virtually self-erecting, requiring only one person for assembly. When sufficient force is applied to the coiled spring steel hoops 42a and 42b, they spring into expanded shape. The bottom edges of the hoops 42a and 42b are then drawn apart such that the floor 28 is expanded to its full width. In doing this, the tops of the hoops 42a and 42b automatically cross over each other since the width at the top of the tent 20 is less than the width at the bottom. Thus, the tent 20 is virtually self-erecting. The tent 20 stands independently, without need to be staked to the ground. There is no need for additional poles, shock cords or ropes. Nevertheless, at the four corners of the rectangular floor 28 there are loops 55 which accept stakes 56 to fasten the tent 20 to the ground. This is advantageous in situations where strong wind or heavy rain might otherwise cause the tent 20 to become unstable. Additionally, when used, the stakes 56 help to pull the fabric taut, providing extra stability.

Figure 8:
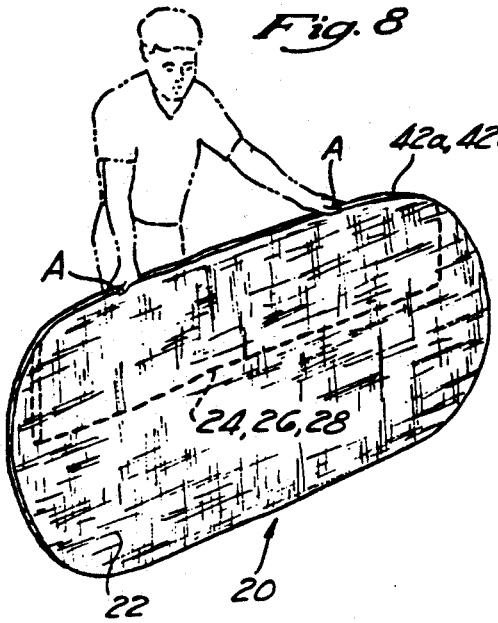

FIGS. 8 through 16 illustrate a method of collapsing the tent 20 of the present invention. First, the tent 20 is turned over so that the floor 28 faces upward. The two oval hoops 42a and 42b are brought together that they overlap one another. The fabric which constitutes the floor 28 of the tent, as well as the front door 24a and the back wall 26, is folded between the two hoops 42a and 42b. The operator now places one hand at either end of the hoops 42a and 42b positioned slightly inwardly from each end of the hoops 42a and 42b. This is shown in FIG. 8. The position of the operator's hands on the hoops 42a and 42b, labelled point A, does not change throughout the disassembly motion. The thumbs of the operator should face away from his body on the side of the tent 20 opposite him while his forefingers are curled around the spring steel of the hoops 42a and 42b on the side of the tent nearest him. The folded over tent 20 should lay at a slight angle from the ground toward the operator. Note that the operator's hands may be placed at many different locations on the spring steel hoops 42a and 42b to collapse the tent 20, but that the positioning described above is the most advantageous.

Figure 9:
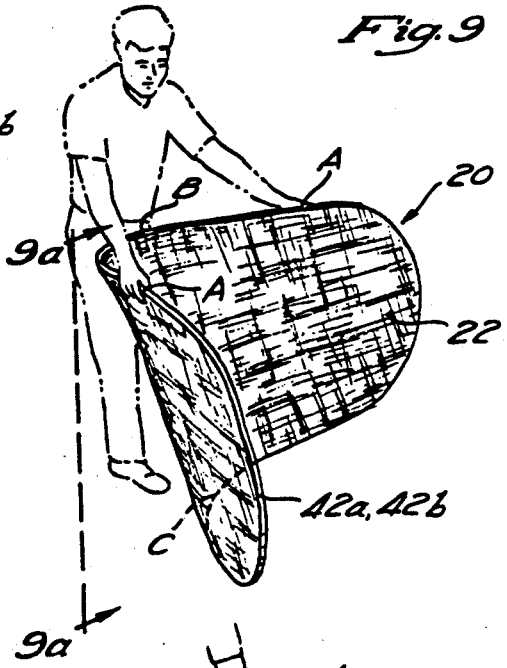
Figure 9A:
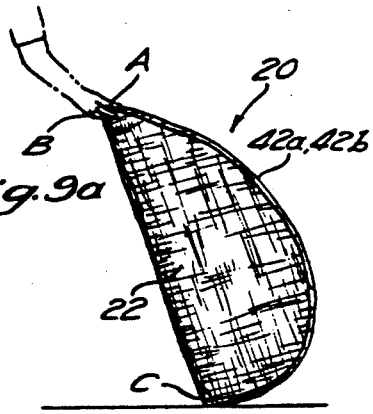
Figure 10:
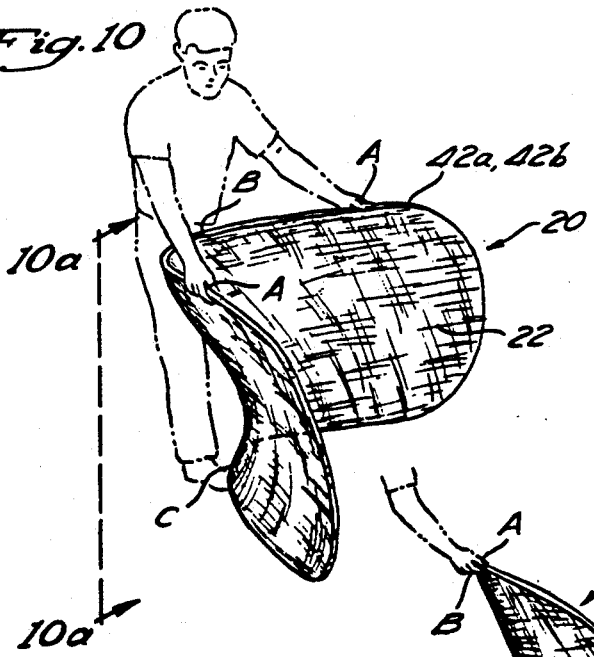
Figure 10A:
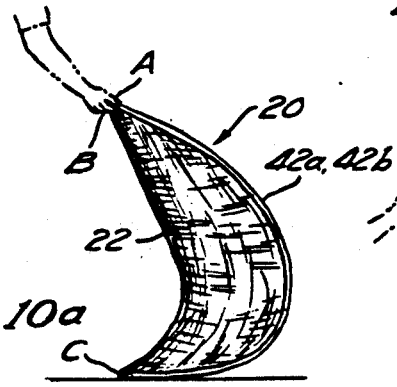

As shown in FIGS. 9 and 9a, the ends of the hoops 42a and 42b are brought toward each other. The motion is discontinued when the ends of the hoops 42a and 42b are approximately thirty degrees from their original position. The operator then presses downwardly without rotating his hands; i.e., his entire forearm moves downwardly, forcing the entire section of frame 40 he is holding to descend uniformly. This causes the sidewalls 22 to curve as shown in FIGS. 10 and 10a. Next, the operator rotates his thumbs upwardly, causing the spring steel section B presently at the top to rotate toward the fabric covering the hoops 42a and 42b, approximately at the midpoint of the fabric covering as shown in FIG. 11. Subsequently, the operator rotates his hands such that his thumbs move slightly further in the upward direction, while at the same time rotating his palms slightly downwardly, as shown by the directional arrows in FIG. 11. This forces the spring steel section B already rotating toward the fabric shell to continue on its path such that it crosses over the spring steel section C previously across from it at the bottom. This is illustrated, with only one hoop 42a or 42b and no fabric covering for clarity, in FIG. 12. The frame 40 begins to form three smaller, circular loops 43, generally arranged along a slightly curved line, as shown schematically in FIG. 13. Again, FIG. 13 uses only one hoop 42a or 42b with no fabric covering for clarity; the tent 20 has two hoops 42a and 42b and a fabric covering.

Figure 13:
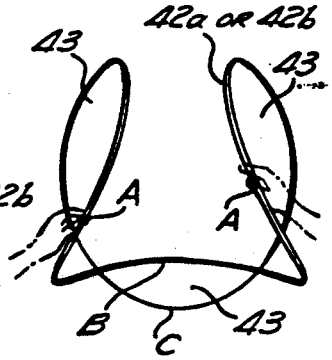

Now the operator rotates his hands further, corresponding to the directional arrows in FIG. 13. Thus, as shown in FIG. 14, the operator's palms face the ground and each of the newly created circular loops 43 is brought over the newly created center circular loop 43. FIG. 14 is again a view of a single hoop 42a or 42b with no fabric covering, for clarity. FIG. 15 illustrates the operator collapsing the tent to the position shown in FIG. 14. The tent 20 now constitutes three circular loops 43 of approximately the same size, folded over each other as shown in FIG. 16. FIG. 16 illustrates this with only one of the original hoops 42a or 42b with no fabric covering for clarity.

Figure 17:
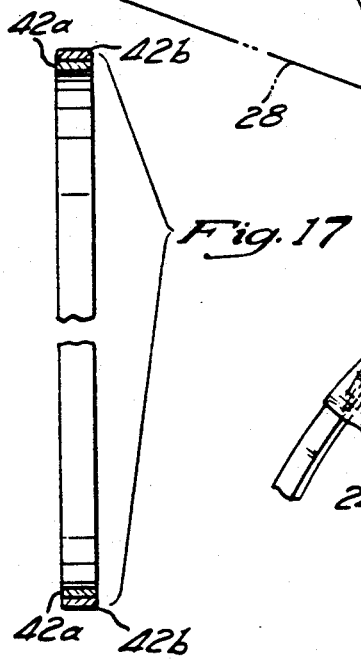
FIG. 17 is an illustration of how the two loops fit one inside the other when the tent is collapsed.

In the tent 20, the two hoops 42a and 42b coil in unison such that the slightly smaller hoop 42a lays directly inside the slightly larger hoop 42b when the tent 20 is collapsed. One of the three concentric circular loops 43 of the collapsed tent 20 is shown in cross-section in FIG. 17, illustrating how the two hoops 42a and 42b fit one inside the other when the tent 20 is collapsed. The collapsed tent 20 can now be inserted into its carrying case 30 for easy transport.

A second method can also be employed for collapsing the tent 20 of the present invention. This method is not illustrated, as it is relatively similar to the first method. First, the two hoops 42a and 42b are brought together such that they overlap one another. The fabric which constitutes the floor 28, the back wall 26, and the front wall 24 and door flap 24a is folded between the two hoops 42a and 42b. The operator now places one curved end of the adjacent hoops 42a and 42b on the ground. The operator's foot is placed over the curved area touching the ground to hold it in place. Thus, the hoops 42a and 42b stand on end.

The operator now bends the curved area opposite his foot towards himself until this section also touches the ground. Thus, the adjacent hoops 42a and 42b are bent generally in half. The half of the hoops 42a and 42b furthest from the operator naturally falls over toward the ground. Thus, one half of the bent hoops 42a and 42b lays on the ground while the other half of the bent hoops 42a and 42b arches over the first half.

The operator now places his hands on opposite lengths of the arched half of the hoops 42a and 42b which are nearest him. His thumbs should be aligned with the axis of the hoops 42a and 42b and his fingers should be wrapped around the hoops 42a and 42b. The curved section of the hoops 42a and 42b which was initially bent toward the ground is now pushed across the curved section which was initially opposite it, toward the bend in the hoops 42a and 42b. This is accomplished by the operator tilting his thumbs toward him. The hoops 42a and 42b begin to form three separate loops 43, as in the first method of collapsing the tent 20. The operator now rotates his palms toward the ground, causing the three separate loops 43 to overlap one another, as in the first method. The final collapsed configuration of the tent 20 is the same, independent of the method used for collapse.

In one embodiment of the present invention, handles with finger holds are introduced on the section of spring steel hoops 42a and 42b where the operator places his hands for collapsing the tent 20. This insures the operator correctly positions his hands to collapse the tent 20. Incorrect positioning can lead to incorrect collapsing of the structure, causing the spring steel hoops 42a and 42b to twist along its axis, preventing dismantling of the tent 20.

In another embodiment of the present invention a dual wall feature may be added. In this embodiment, shown in perspective in FIG. 18 and in cross-section in FIG. 18a, a permanent second layer of material is added to the structure to provide extra protection from the elements. This allows the tent 20 to be used in a greater number of climates and seasons than the single wall design. An inner layer, made up of two sidewalls 22a, is generally constructed from a semi-permeable fabric. A section along the bottom of each of the spring steel hoops 42a and 42b is sewn in a channel 50 created along the bottom and sides of the inner layer sidewalls 22a. A cross section of the channel 50 is shown towards the bottom of the tent 20 in FIG. 18a.

The hoops 42a and 42b extend out of openings at the top of the channels 50 created along the bottom and sides of each inner layer sidewall 22a. Thus, the top of the inner layer is not attached to the spring steel hoops 42a and 42b. Instead, it folds over underneath the top of the erect frame 40, creating a fold-over area 23a along the line connecting the exit holes 50a from the channels 50. Since the hoops 42a and 42b extend out of the channels 50, the straight portions at the top of the spring steel hoops 42a and 42b do not touch the fabric of the fold-over area 23a. Thus, there is no fabric ridgeline support 23 connecting the two inner layer sidewalls 22a; a fold-over area 23a at the top suffices.

A second, outer layer is sewn such that is rests over the top of the frame 40. This layer comprises two sidewalls 22b, generally constructed from a non-permeable fabric. Since the spring steel hoops 42a and 42b do contact the fabric at the top of the erect inner layer a fabric ridgeline support 23 is added between the top of the two outer layer sidewalls 22b to restrain the spring steel hoops 42a and 42b the same way as in the single wall design. The fold over area 23a may additionally be attached to the fabric ridgeline support 23 to provide more vertical clearance inside the tent.

Both the inner and outer layer sidewalls, 22a and 22b respectively, are attached to the floor 28 of the tent 20. The outer layer sidewalls 22b can additionally be attached along either the circumference of the hoops 42a and 42b, using the inner and outer layer to create a channel 50, or along the edges of the inner layer sidewalls 22a. Since the first layer is slightly recessed from the frame 40 while the second layer rests on top of the frame 40, a small pocket 65 is created between the inner and outer sidewalls, 22a and 22b, respectively. Moisture, produced by body heat or respiration, for example, can escape from the inner walls 22a of the tent 20, yet external moisture, from rain for example, cannot permeate the material of the outer layer to reach the occupant of the tent 20. Thus, the dual wall design provides a wider range of seasonal use for the collapsible tent 20.

Figures 18, 19, 19A, 21:
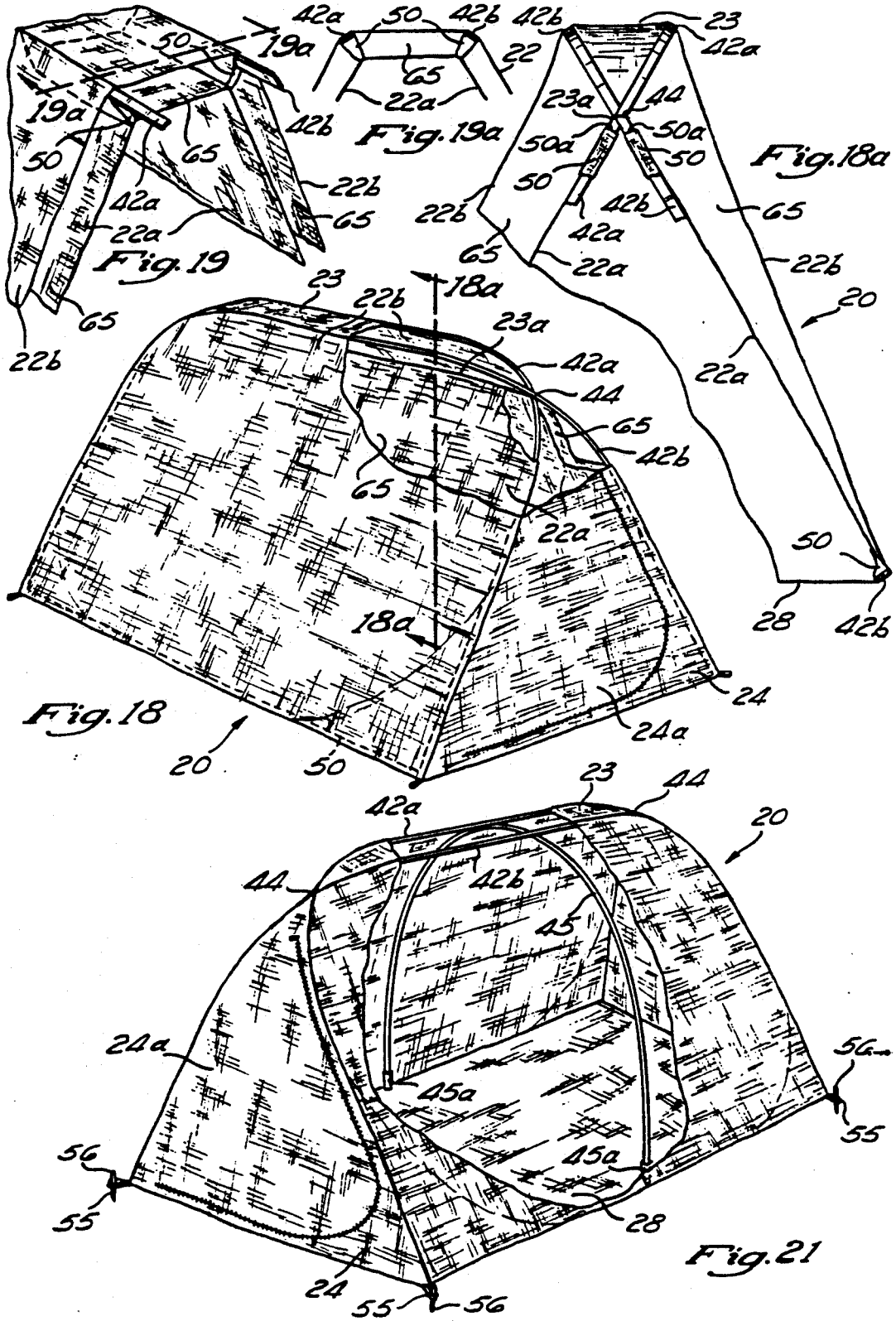
FIG. 18 is another embodiment of the collapsible tent wherein a second layer of material is permanently added to form a dual sidewall which offers greater protection against the elements and reduces condensation on the inner wall.
FIG. 19 is another embodiment of the collapsible tent wherein a second layer of material, or rain fly, is added to form a dual sidewall which offers greater protection against the elements. In this embodiment, the second layer can be removed.
FIG. 21 is another embodiment of the collapsible tent wherein a rod, bent into semi-circular shape, is inserted in a plane perpendicular to the longitudinal axis, at approximately the center of the tent, to provide additional stability to the tent.

The pocket 65 created between the two layers is shown more clearly in the cross-sectional view of FIG. 18a. Looking directly down the line 18a in FIG. 18, the cross-section of the inner layer, made up of two sidewalls 22a, is seen first. Further back, the two spring steel hoops 42a and 42b cross over, partially covered in this view by the cross-section of the inner layer's sidewalls 22a. The hoops 42a and 42b extend out of openings 50a at the top of the channels 50. To illustrate how the spring steel hoops 42a and 42b are encased by the channels 50 created along the edge of the inner layer, both the channels 50 and the hoops 42a and 42b are shown severed just below the fold-over area 23a at the top the inner layer. The outer layer rests on top of the displaced hoops 42a and 42b. The pocket 65 is created between the inner layer sidewalls 22a and the outer layer sidewalls 22b.

Another embodiment of the present invention incorporates a second type of dual wall design, as shown in FIG. 19. This embodiment allows the tent 20 to be used in either single or dual wall form. The spring steel hoops 42a and 42b are sewn into enlarged channels 50 created around the hoops 42a and 42b. The fabric of the sidewalls 22a is of breadth such that when the tent 20 is erect the sidewalls 22a and enlarged channels 50 are pulled taut, away from the frame 40. Thus, the sidewalls 22a are slightly recessed from the frame, corresponding to the width of the channels 50.

In agreeable weather, the tent 20 can be used with only this first layer. In inclement weather, a second, nonpermeable layer can be draped over the frame 40. A small pocket 65 results between the sidewalls of the first layer 22a, which are stretched downwardly from the frame 40, and the outer layer's sidewalls 22b, which rest over the frame 40. This provides escape for moisture from within the tent 20 while hindering moisture from entering the tent 20 from outside. Thus, the tent 20 can be used with one or two layers, in a greater number of environments, and in a greater number of seasons.

Other embodiments of the present invention provide additional support to the tent 20. This extra support mechanism can be added to any of the above embodiments of the tent 20 to provide extra stability. One actualization of this support mechanism is shown in FIG. 20. A separate, generally circular spring steel hoop 47 of great enough size to touch both the top of the frame 40 and the ground, when installed laterally inside the tent 20, is added. The circular loop 43 contacts the displaced sections of the spring steel hoops 42a and 42b at the top of the tent 20 and, consequently, buttresses the frame 40. This added spring steel hoop 47 is easily collapsible such that it will fit into the carrying bag 30 when not in use. Additionally, it is easily opened and installed inside the tent 20 by the occupant.

Another method of adding support to the frame 40 is to place a cross brace across the displaced hoops 42a and 42b at the top of the tent 20, in the area between the cross-over points 44. This method is not illustrated in the Figures. However, it will insure that the hoops 42a and 42b remain in one position relative to one another, even if external forces act to separate them. To collapse the tent 20 the cross-brace would be removed and packaged in the carrying case 30.

Still another method of adding strength to the frame 40 is shown in FIG. 21. Here, a flexible fiberglass shock corded pole 45, wherein a fiberglass tube with elastic through the core, is bent into a semicircle by the occupant of the tent 20. The bent pole 45 is placed laterally across the tent 20 with the arch at the top, providing extra support for the frame 40. Sockets 45a at the bottom of the tent 20 can hold the legs of the semicircular support 45. Additionally, velcro can be added to both the fiberglass pole 45 and corresponding points on the tent frame 40 or fabric shell to affix the pole to the tent 20.

One skilled in the art will realize that the tent shell and other parts of the tent 20, such as the yoke patches 46, can be manufactured from any material suitable for its purpose. Additionally, the carrying case 30 may be of any type with only the restriction that the collapsed tent 20 fit inside it. The frame 40 may be made of any suitable gauge of spring steel or other flexible material. Further, the supplementary support mechanisms may be made of any suitable substance. The accoutrements on the tent 20, such as the window 27 and door 24a, may also be made in any suitable fashion and located at any suitable place on the tent 20.

The invention may be embodied in specific form other than those disclosed herein without departing from the invention's spirit or essential characteristics. The disclosed embodiments are to be considered in all respects only an illustration and not restrictive. The scope of the invention is, therefore, indicated by the appended claims rather than the foregoing description. All changes which come within the meaning and range of equivalency of the claims are to be embraced within their scope.

What is claimed is:

1. A structure comprising:

a plurality of flexible hoop members each of which is generally oval-shaped in an expanded position and collapses into three generally circular loops of a smaller size than the expanded oval-shape;

a cover panel extending over said flexible hoop members and affixed to said hoop members at several points along a perimeter of said hoop members to form opposing first and second side walls when said hoop members are in said expanded position, each of said side walls having an upper and a lower edge wherein said upper edges of said first side wall and said second side wall form an apex;

a hinge proximate said apex connecting said hoop members when said hoop members are in said expanded position; and a floor panel affixed to said lower edge of said first side wall and said lower edge of said second side wall, wherein a first one of said flexible hoop members in its expanded position is smaller than a second one of said flexible hoop members in its expanded position such that said first hoop member can accept said second hoop member within its interior and wherein said hinge comprises a first yoke and a second yoke for securing said first and second hoop members to one another so that said first hoop and said second hoop cross over one another at said first yoke and said second yoke when said structure is erect, said first yoke and said second yoke allowing scissor motion of said flexible hoop members relative to one another.

2. The structure of claim 1, wherein said yoke is comprised of leather and is affixed to said side walls.

3. The structure of claim 1, wherein said yoke is a ring.

* * * * *